US009322553B2

(12) United States Patent
Parsania et al.

(10) Patent No.: US 9,322,553 B2
(45) Date of Patent: Apr. 26, 2016

(54) WAKE MANIPULATING STRUCTURE FOR A TURBINE SYSTEM

(71) Applicant: General Electric Company, Schenectady, NY (US)

(72) Inventors: Nishant Govindbhai Parsania, Karnataka (IN); Chandrasekhar Pushkaran, Karnataka (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 449 days.

(21) Appl. No.: 13/889,803

(22) Filed: May 8, 2013

(65) Prior Publication Data

US 2014/0331681 A1 Nov. 13, 2014

(51) Int. Cl.
*F23R 3/00* (2006.01)
*F23R 3/12* (2006.01)

(52) U.S. Cl.
CPC .. *F23R 3/002* (2013.01); *F23R 3/12* (2013.01)

(58) Field of Classification Search
CPC .... F05D 2260/2212; F23R 3/002; F23R 3/04; F23R 3/10; F23R 3/12; F23R 3/286; F23R 3/54
See application file for complete search history.

(56) References Cited

U.S. PATENT DOCUMENTS

| | | | | |
|---|---|---|---|---|
| 3,643,426 | A | 2/1972 | Janelid | |
| 3,734,639 | A | 5/1973 | Short | |
| 4,259,842 | A | 4/1981 | Koshoffer et al. | |
| 4,786,016 | A | 11/1988 | Presz et al. | |
| 4,802,821 | A | 2/1989 | Drietmeier | |
| 4,844,689 | A | 7/1989 | Seed | |
| 4,896,510 | A | 1/1990 | Foltz | |
| 4,968,216 | A | 11/1990 | Anderson et al. | |
| 5,226,278 | A | 7/1993 | Meylan et al. | |
| 5,274,991 | A | 1/1994 | Fitts | |
| 5,406,786 | A | 4/1995 | Scharpf et al. | |
| 5,486,091 | A | 1/1996 | Sharma | |
| 5,749,218 | A | 5/1998 | Cromer et al. | |
| 5,785,498 | A | 7/1998 | Quinn et al. | |
| 5,797,267 | A * | 8/1998 | Richards | F23R 3/346 60/737 |
| 5,813,828 | A | 9/1998 | Norris | |
| 6,174,129 | B1 | 1/2001 | Mazzola et al. | |

(Continued)

FOREIGN PATENT DOCUMENTS

| | | | |
|---|---|---|---|
| CN | 101050722 | A | 10/2007 |
| CN | 101173673 | A | 5/2008 |

(Continued)

OTHER PUBLICATIONS

English Translation of Chinese Office Action for CN Application No. 201210369382.6, dated Feb. 25, 2015, pp. 1-11.

(Continued)

*Primary Examiner* — Andrew Nguyen
(74) *Attorney, Agent, or Firm* — Dority & Manning, PA

(57) ABSTRACT

A wake manipulating structure for a turbine system includes a combustor liner defining a combustor chamber. Also included is an airflow path located along an outer surface of the combustor liner. Further included is a wake generating component disposed in the airflow path and proximate the combustor liner, wherein the wake generating component generates a wake region located downstream of the wake generating component. Yet further included is a venturi structure or section disposed in the airflow path configured to reduce the wake region.

16 Claims, 4 Drawing Sheets

(56) References Cited

U.S. PATENT DOCUMENTS

| | | | | |
|---|---|---|---|---|
| 6,209,325 | B1 | 4/2001 | Alkabie | |
| 6,345,493 | B1 | 2/2002 | Smith et al. | |
| 6,402,458 | B1 | 6/2002 | Turner | |
| 6,409,126 | B1 | 6/2002 | Cunningham, Jr. | |
| 6,435,814 | B1 | 8/2002 | Yu et al. | |
| 6,438,961 | B2 | 8/2002 | Tuthill et al. | |
| 6,442,941 | B1 | 9/2002 | Anand et al. | |
| 6,446,438 | B1 | 9/2002 | Kraft et al. | |
| 6,484,505 | B1 | 11/2002 | Brown et al. | |
| 6,527,503 | B2 | 3/2003 | Spano et al. | |
| 6,543,234 | B2 | 4/2003 | Anand et al. | |
| 6,554,562 | B2 | 4/2003 | Dudebout et al. | |
| 6,584,779 | B2 | 7/2003 | Priestley | |
| 6,598,398 | B2 | 7/2003 | Viteri et al. | |
| 6,602,458 | B1 | 8/2003 | Skov | |
| 6,626,635 | B1 | 9/2003 | Prowse | |
| 6,772,595 | B2 | 8/2004 | Martling et al. | |
| 6,824,710 | B2 | 11/2004 | Viteri et al. | |
| 6,899,081 | B2 | 5/2005 | Bielicki et al. | |
| 6,910,335 | B2 | 6/2005 | Viteri et al. | |
| 6,935,116 | B2 | 8/2005 | Stuttaford et al. | |
| 6,958,383 | B2 | 10/2005 | Desmazeau et al. | |
| D511,377 | S | 11/2005 | Erwan et al. | |
| 7,007,478 | B2 | 3/2006 | Dinu | |
| 7,089,742 | B2 | 8/2006 | Spooner et al. | |
| 7,340,129 | B2 | 3/2008 | Yalin et al. | |
| 7,373,773 | B2 | 5/2008 | Noda | |
| 7,410,343 | B2 | 8/2008 | Wakazono et al. | |
| 7,412,129 | B2 | 8/2008 | Yalin et al. | |
| 7,420,662 | B2 | 9/2008 | Yalin et al. | |
| 7,574,865 | B2 | 8/2009 | Bland | |
| 7,594,401 | B1 * | 9/2009 | Chen | F01D 9/023 60/752 |
| 7,654,320 | B2 | 2/2010 | Payton | |
| 7,762,074 | B2 | 7/2010 | Bland et al. | |
| 7,805,946 | B2 | 10/2010 | Ohri et al. | |
| 7,896,645 | B2 | 3/2011 | Loving | |
| 8,234,872 | B2 | 8/2012 | Berry et al. | |
| 8,307,657 | B2 | 11/2012 | Chila | |
| 8,308,112 | B2 | 11/2012 | Wood et al. | |
| 8,516,822 | B2 | 8/2013 | Chen et al. | |
| 8,707,672 | B2 | 4/2014 | Zuo et al. | |
| 2002/0020173 | A1 * | 2/2002 | Varney | F23C 6/047 60/737 |
| 2002/0048510 | A1 | 4/2002 | Spano et al. | |
| 2002/0124572 | A1 | 9/2002 | Pidcock et al. | |
| 2003/0136102 | A1 | 7/2003 | Nottin | |
| 2005/0172607 | A1 | 8/2005 | Ishizaka et al. | |
| 2005/0206196 | A1 | 9/2005 | Ortega et al. | |
| 2006/0101801 | A1 | 5/2006 | Bland | |
| 2006/0283189 | A1 | 12/2006 | Lipinski et al. | |
| 2007/0130958 | A1 | 6/2007 | Ohri et al. | |
| 2007/0251240 | A1 | 11/2007 | Johnson et al. | |
| 2009/0155062 | A1 | 6/2009 | Guimbard et al. | |
| 2009/0184181 | A1 * | 7/2009 | Berry | F23R 3/286 239/554 |
| 2009/0223228 | A1 | 9/2009 | Romoser | |
| 2009/0320484 | A1 | 12/2009 | Lacy et al. | |
| 2010/0031665 | A1 * | 2/2010 | Chokshi | F01D 5/186 60/760 |
| 2010/0054929 | A1 | 3/2010 | Ning et al. | |
| 2010/0111684 | A1 | 5/2010 | Ning et al. | |
| 2010/0122538 | A1 | 5/2010 | Ning et al. | |
| 2010/0287943 | A1 | 11/2010 | Mcmahan et al. | |
| 2010/0326082 | A1 | 12/2010 | Ziminsky et al. | |
| 2011/0107766 | A1 | 5/2011 | Davis, Jr. et al. | |
| 2011/0197586 | A1 | 8/2011 | Berry et al. | |
| 2011/0214429 | A1 | 9/2011 | Chen et al. | |
| 2012/0085100 | A1 | 4/2012 | Hughes et al. | |
| 2012/0159954 | A1 | 6/2012 | Ito et al. | |
| 2012/0167586 | A1 | 7/2012 | Bailey et al. | |
| 2012/0186255 | A1 | 7/2012 | Parsania et al. | |
| 2012/0247118 | A1 | 10/2012 | Antoniono et al. | |
| 2012/0297783 | A1 * | 11/2012 | Melton | F23R 3/002 60/772 |
| 2012/0297785 | A1 | 11/2012 | Melton et al. | |
| 2012/0297786 | A1 * | 11/2012 | Crawley | F23R 3/02 60/772 |
| 2013/0115566 | A1 | 5/2013 | Khan et al. | |
| 2014/0041357 | A1 | 2/2014 | Malandra et al. | |

FOREIGN PATENT DOCUMENTS

| | | | |
|---|---|---|---|
| EP | 1130321 | A1 | 9/2001 |
| EP | 1482246 | A1 | 12/2004 |
| EP | 2154431 | A2 | 2/2010 |
| JP | 54114619 | A | 9/1979 |

OTHER PUBLICATIONS

Extended European Search Report for EP Application No. 12190915.4-1602, dated Feb. 11, 2013, pp. 1-8.

Extended European Search Report for EP Application No. 12190923.8-1602, dated Feb. 13, 2013, pp. 1-7.

* cited by examiner

WAKE MANIPULATING STRUCTURE FOR A TURBINE SYSTEM

BACKGROUND OF THE INVENTION

The subject matter disclosed herein relates to turbine systems, and more particularly to a wake manipulating structure for such turbine systems.

Combustor arrangements are often of a reverse-flow configuration and include a liner formed of sheet metal. The sheet metal and an outer boundary component form a path for air received from the compressor outlet to flow in a direction toward a head end of the combustor, where the air is then turned into nozzles and mixed with fuel in a combustor chamber. Various components that serve structural and functional benefits may be located along the airflow path. These components result in wake regions located proximate a downstream side of the components. These wake regions lead to pressure drops and non-uniform airflow as the air is provided to the nozzles at the head end, thereby leading to undesirable effects such as increased NOx emission and less efficient overall operation.

BRIEF DESCRIPTION OF THE INVENTION

According to one aspect of the invention, a wake manipulating structure for a turbine system includes a combustor liner defining a combustor chamber. Also included is an airflow path located along an outer surface of the combustor liner. Further included is a wake generating component disposed in the airflow path and proximate the combustor liner, wherein the wake generating component generates a wake region located downstream of the wake generating component. Yet further included is a venturi structure disposed in the airflow path and comprising at least one inlet hole and at least one outlet hole, the at least one outlet hole circumferentially aligned with the wake generating component at an axially downstream location of the wake generating component.

According to another aspect of the invention, a wake manipulating structure for a turbine system includes a combustor liner defining a combustor chamber. Also included is an airflow path located along an outer surface of the combustor liner. Further included is a wake generating component disposed in the airflow path and proximate the combustor liner, wherein the wake generating component generates a wake region located downstream of the wake generating component. Yet further included is a venturi structure disposed in the airflow path and comprising at least one slot circumferentially aligned with the wake generating component at an axially downstream location of the wake generating component.

According to yet another aspect of the invention, a wake manipulating structure for a turbine system includes an airflow path located along an outer surface of a combustor liner. Also included is a wake generating component disposed in the airflow path and proximate the combustor liner, wherein the wake generating component generates a wake region located downstream of the wake generating component. Further included is a first venturi section disposed in the airflow path. Yet further included is a second venturi section disposed downstream of the first venturi section.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
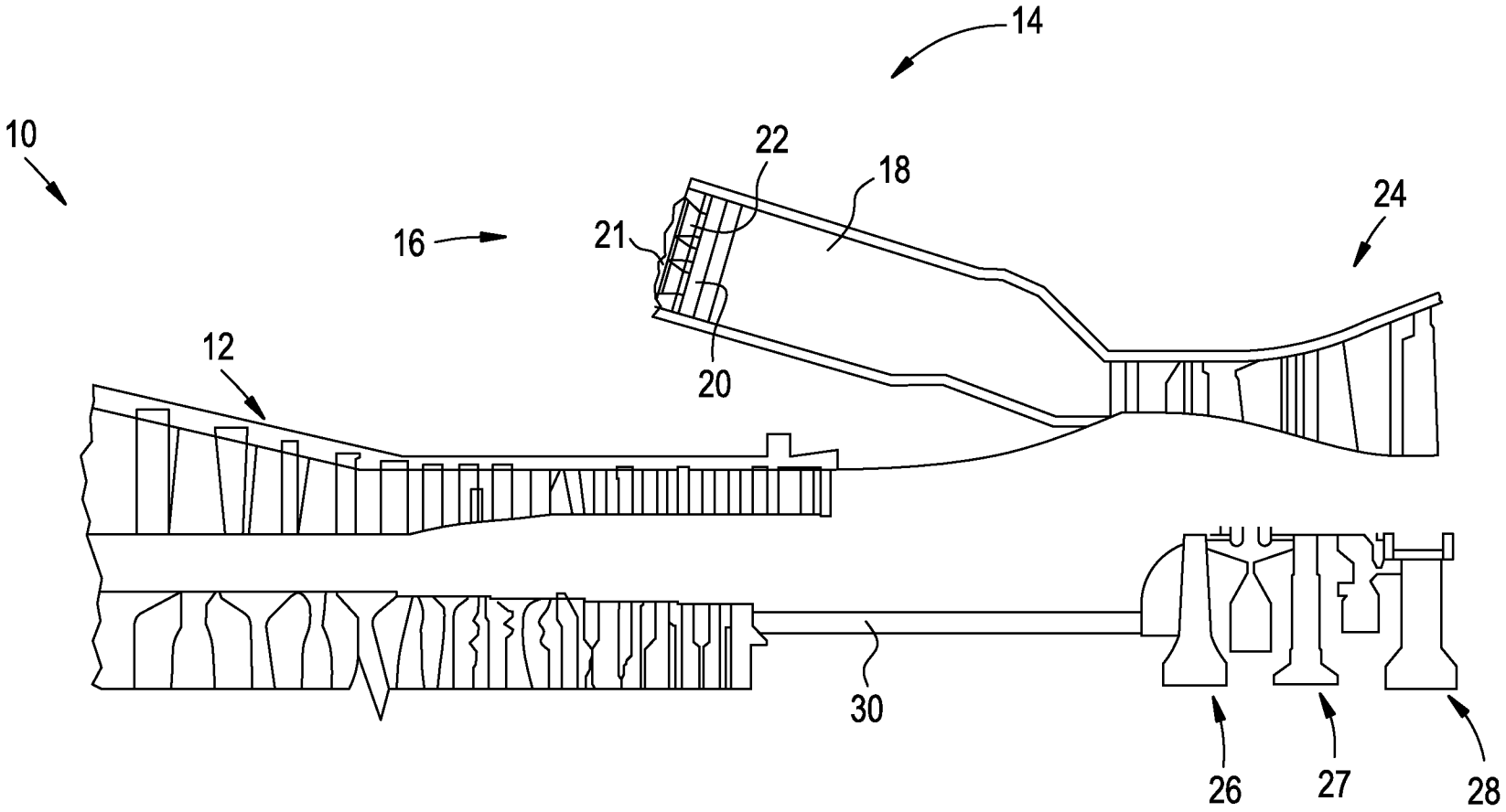
FIG. 1 is a schematic illustration of a turbine system.

Referring to FIG. 1, a turbine system, such as a gas turbine engine 10, constructed in accordance with an exemplary embodiment of the present invention is schematically illustrated. The gas turbine engine 10 includes a compressor 12 and a plurality of combustor assemblies arranged in a can annular array, one of which is indicated at 14. As shown, the combustor assembly 14 includes an endcover assembly 16 that seals, and at least partially defines, a combustor chamber 18. A plurality of nozzles 20-22 are supported by the endcover assembly 16 and extend into the combustor chamber 18. The nozzles 20-22 receive fuel through a common fuel inlet (not shown) and compressed air from the compressor 12. The fuel and compressed air are passed into the combustor chamber 18 and ignited to form a high temperature, high pressure combustion product or air stream that is used to drive a turbine 24. The turbine 24 includes a plurality of stages 26-28 that are operationally connected to the compressor 12 through a compressor/turbine shaft 30 (also referred to as a rotor).

In operation, air flows into the compressor 12 and is compressed into a high pressure gas. The high pressure gas is supplied to the combustor assembly 14 and mixed with fuel, for example natural gas, fuel oil, process gas and/or synthetic gas (syngas), in the combustor chamber 18. The fuel/air or combustible mixture ignites to form a high pressure, high temperature combustion gas stream. In any event, the combustor assembly 14 channels the combustion gas stream to the turbine 24 which converts thermal energy to mechanical, rotational energy.

Figure 2:
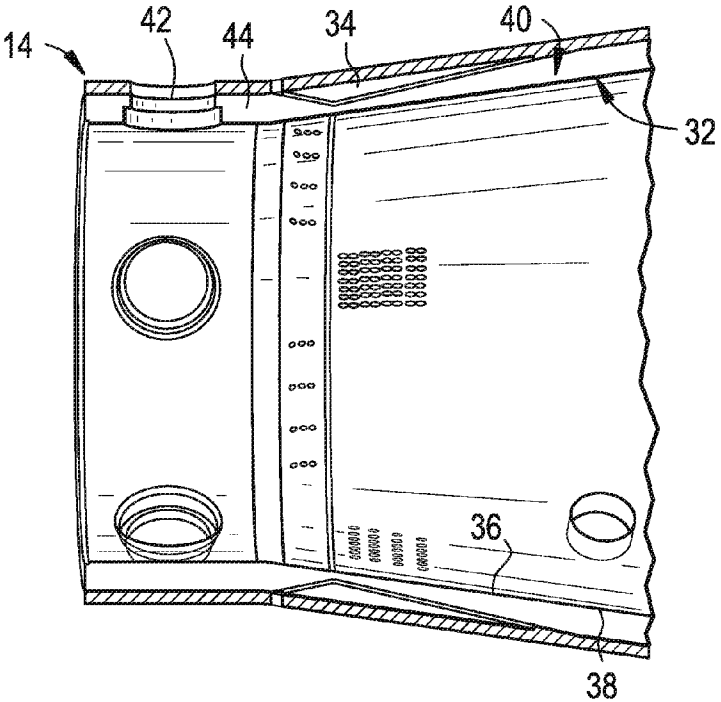
FIG. 2 is a partial cross-sectional view of a portion of a combustor assembly of the turbine system.

Referring now to FIG. 2, a portion of the combustor assembly 14 is illustrated. As noted above, the combustor assembly 14 is typically one of several combustors operating within the gas turbine engine 10, which are often circumferentially arranged. The combustor assembly 14 is often tubular in geometry and directs the hot pressurized gas into the turbine section 24 of the gas turbine engine 10.

The combustor assembly 14 is defined by a combustor liner 32 which is at least partially surrounded at a radially outward location by an outer boundary component 34, such as a flow sleeve, for example. Specifically, the combustor liner 32 includes an inner surface 36 and an outer surface 38, where the inner surface 36 defines the combustor chamber 18. An airflow path 40 formed between the outer surface 38 of the combustor liner 32 and the outer boundary component 34 provides a region for an airstream to flow therein toward nozzles of the combustor assembly 14. Although illustrated and previously described as having the flow sleeve surrounding the combustor liner 32, it is contemplated that only the combustor liner 32 is present, with the outer boundary component 34 comprising an outer casing or the like. Disposed within, or partially protruding into, the airflow path 40 is at least one wake generating component 42. The wake generating component 42 generically refers to any structural member and may provide various structural and/or functional benefits to the gas turbine engine 10. For example, the wake generating component 42 comprises a fuel injector extending radially inwardly through the combustor liner 32, a tube such as a cross-fire tube that fluidly couples adjacent combustor chambers, cameras, a spark plug, or a flame detector, etc. The preceding list is merely exemplary and it is to be understood that the wake generating component 42 may refer to any structural member disposed in the airflow path 40.

As air flowing within the airflow path 40 encounters the wake generating component 42, a wake region 44 is generated downstream of the wake generating component 42. Specifically, the wake region 44 may extend from immediately adjacent a downstream end of the wake generating component 42 to locations proximate the downstream end of the wake generating component 42. Various embodiments described herein reduce the wake region 44 by imposing an energizing effect on a mass of air around the wake generating component 42 to fill in the wake region 44. Specifically, the embodiments described below result in a venturi effect on air 46 flowing with the airflow path 40.

Figure 4:
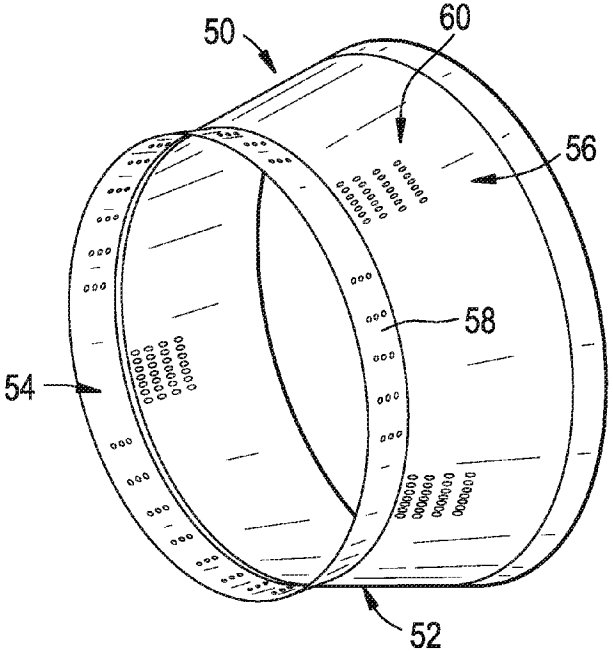
FIG. 4 is a perspective view of a venturi structure according to a first embodiment.
Figure 3:
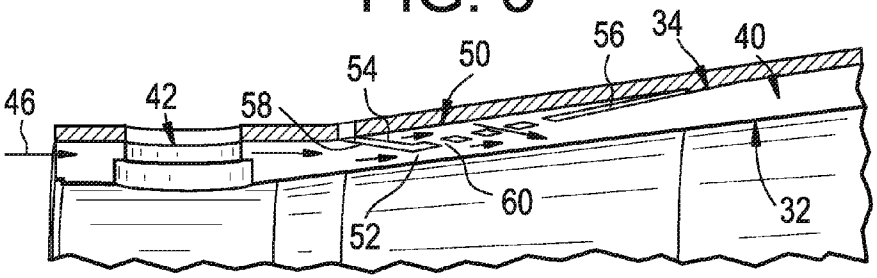
FIG. 3 is a partial cross-sectional view of an airflow path of the combustor assembly.

Referring to FIGS. 3 and 4, a wake manipulating structure 50 according to a first embodiment is illustrated and the wake generating component 42 is illustrated in greater detail. As air flows around the wake generating component 42, air separation and wake results, as described in detail above. The wake manipulating structure 50 includes a venturi structure 52 disposed in the airflow path 40 for manipulating the air 46 flowing therealong. The venturi structure 52 is operatively coupled to the outer boundary component 34 that defines the airflow path in conjunction with the combustor liner 32. As described in detail above, the outer boundary component 34 refers to a flow sleeve, outer casing or the like. The operative coupling of the venturi structure 52 to the outer boundary component 34 may be accomplished with any suitable attachment process including, but not limited to, welding and/or mechanical fastening.

The venturi structure 52 may be formed of numerous suitable materials, including sheet metal and includes a convergent portion 54, as well as a divergent portion 56. More specifically, the airflow path 40 includes a region of converging airflow and diverging airflow that is formed by inclusion of the convergent portion 54 and the divergent portion 56, respectively. As the air 46 travels along the convergent portion 54, the velocity increases and an associated pressure drop is imposed in this region due to the restriction of cross-sectional area proximate the convergent portion 54. Extending through the convergent portion 54 is at least one, but typically a plurality of inlet holes 58 for the air 46 to enter. The plurality of inlet holes 58 are located in position(s) circumferentially offset from the wake generating component 42, but typically relatively aligned in an axial plane. Axial flow in these circumferential locations is relatively strong and uniform, such that drawing of air in these locations is acceptable. Extending through the divergent portion 56 is at least one, but typically a plurality of outlet holes 60. The plurality of outlet holes 60 is circumferentially aligned with the wake generating component 42 and located axially downstream of the wake generating component 42. The plurality of outlet holes 60 is located in-line with, and downstream of, the wake generating component 42 in the wake region 44 to provide a suction side for the air that is ingested into the plurality of inlet holes 58 to be drawn to.

In operation, the air 46 flows into the plurality of inlet holes 58 at regions not circumferentially aligned with the wake generating component 42 and is routed axially downstream and circumferentially to the plurality of outlet holes 60 in order to energize and "fill-in" the wake region 44 located axially downstream of the wake generating component 42.

Figure 5:
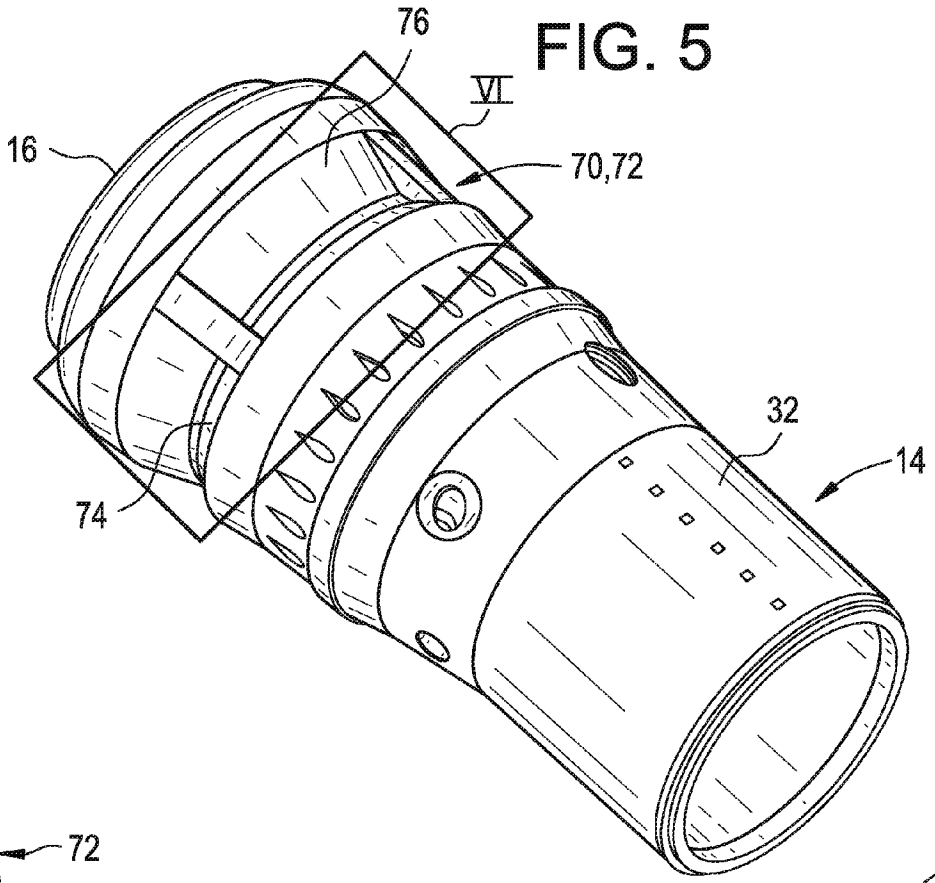
FIG. 5 is a perspective view of the combustor assembly having a venturi structure according to a second embodiment.
Figure 6:
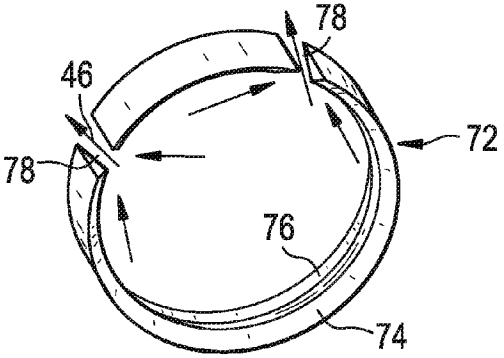
FIG. 6 is an enlarged perspective view of the venturi structure of section VI of FIG. 5.

Referring now to FIGS. 5 and 6, a wake manipulating structure 70 according to a second embodiment is illustrated. The wake manipulating structure 70 is operatively coupled to the combustor assembly 14. For example, the wake manipulating structure 70 may be coupled to the outer boundary component 34 or the endcover assembly 16. As described above with respect to the first embodiment, operative coupling may be achieved by welding, mechanically fastening, and/or a similar fashion.

The wake manipulating structure 70 includes a venturi structure 72 that includes a convergent portion 74 and a divergent portion 76 that extend circumferentially around the combustor liner 32 to impose a converging and diverging section along the airflow path 40, as described in detail above regarding the first embodiment. However, the venturi structure 72 of the second embodiment of the wake manipulating structure 70 does not extend continuously around the combustor liner 32. Rather, at least one slot 78 is included in locations circumferentially aligned with, and axially downstream of, the wake generating component 42. The at least one slot 78 is formed of numerous geometries, including circular or rectangular, for example, and allows low velocity recirculation of air through low resistance provided by the at least one slot 78. The wake region 44 proximate the at least one slot 78 is energized as flow of the air 46 enters the at least one slot 78 from relatively circumferential directions of flow of the air 46. Specifically, a relatively low pressure drop draws the air toward the at least one slot 78 from the side in a circumferential manner to assist with energizing the wake region 44.

Figure 7:
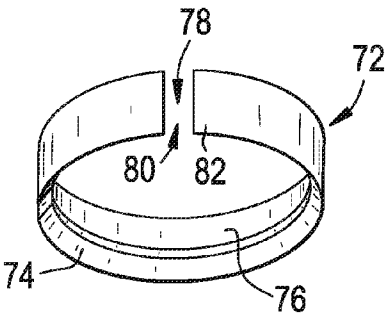
FIG. 7 is an enlarged perspective view of the venturi structure of FIG. 5 according to another aspect of the invention.

As shown in FIG. 7, in one embodiment the at least one slot 78 of the venturi structure 72 may include a mouth region 80 that increases the flow of the air 46 proximate an inlet region 82 of the at least one slot 78. The mouth region 80 may be funnel-shaped to draw in the flow of the air 46.

Figure 8:
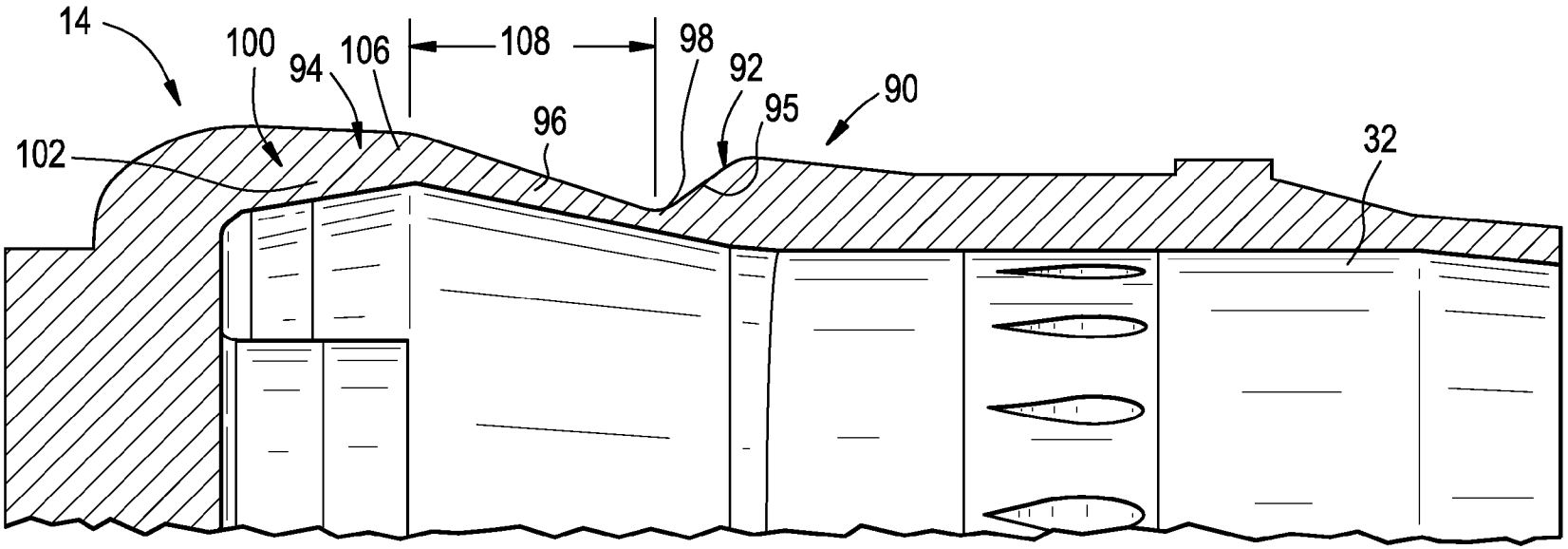
FIG. 8 is a partial cross-sectional view of a venturi structure according to a third embodiment.

Referring now to FIG. 8, a wake manipulating structure 90 according to a third embodiment is illustrated. The third embodiment includes several aspects of the embodiments described above, such that duplicative description is not necessary and similar reference numerals are employed where applicable. The wake manipulating structure 90 includes a first venturi section 92 and a second venturi section 94. The first venturi section 92 includes a first convergent portion 95 and a first divergent portion 96, separated by a first throat 98. Similarly, the second venturi section 100 includes a second convergent portion 102 and a second divergent portion 104, separated by a second throat 106. It is contemplated that the first venturi section 92 and the second venturi section 94 are circumferentially offset from each other, with one of the sections circumferentially aligned with, and axially downstream of, the wake generating component 42. The first throat 98 and the second throat 106 are axially offset from each other by a distance 108 determined, at least in part, by a length of the first convergent portion 95. In one embodiment, the offset 108 ranges from about 0.3 to 1.3 times the length of the first convergent portion 95. Such an arrangement allows a "zig-zag" flow profile that results in relatively slow divergence of the air 46, thereby reducing or avoiding separation of flow.

Advantageously, airflow uniformity is increased as the airflow is routed to the head end nozzles, which promotes increased overall efficiency of the gas turbine engine 10, as well as reduced NOx emission by making flow uniform and equally dividing the air into downstream fuel nozzles. This is accomplished with a lower pressure drop than other systems require and improves cooling of the combustor liner 32 by increasing the heat transfer coefficient in the vicinity of the wake generating component 42.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A wake manipulating structure for a turbine system, comprising:

a combustor liner defining a combustor chamber;

an airflow path located along an outer surface of the combustor liner;

a wake generating component disposed in the airflow path and proximate the combustor liner, wherein the wake generating component generates a wake region located downstream of the wake generating component; and a venturi structure disposed in the airflow path and defining at least one inlet hole and at least one outlet hole downstream of the at least one inlet hole, the at least one outlet hole circumferentially aligned with the wake generating component at an axially downstream location of the wake generating component and in the wake region, wherein the venturi structure comprises a convergent portion and a divergent portion, and wherein the at least one inlet hole extends through the convergent portion and the at least one outlet hole extends through the divergent portion.

2. The wake manipulating structure of claim 1, wherein the airflow path is defined by the outer surface of the combustor liner and a flow sleeve.

3. The wake manipulating structure of claim 2, wherein the venturi structure is operatively coupled to the flow sleeve.

4. The wake manipulating structure of claim 1, wherein the airflow path is defined by the outer surface of the combustor liner and an outer casing.

5. The wake manipulating structure of claim 4, wherein the venturi structure is operatively coupled to the outer easing.

6. The wake manipulating structure of claim 1, wherein the at least one inlet hole and the at least one outlet hole are circumferentially offset from each other.

7. The wake manipulating structure of claim 1, further comprising a plurality of inlet holes axially aligned with each other.

8. The wake manipulating structure of claim 1, wherein the wake generating component comprises at least one of: a fuel injector, a tube, a spark plug, and a flame detector.

9. The wake manipulating structure of claim 1, wherein the venturi structure comprises sheet metal.

10. A wake manipulating structure for a turbine system, comprising:

a combustor liner defining a combustor chamber;

an airflow path located along an outer surface of the combustor liner;

a wake generating component disposed in the airflow path and proximate the combustor liner, wherein the wake generating component generates a wake region located downstream of the wake generating component; and a venturi structure disposed in the airflow path and defines at least one slot circumferentially aligned with the wake generating component at an axially downstream location of the wake generating component and in the wake region, wherein the venturi structure comprises a convergent portion and the divergent portion, and wherein the at least one slot comprises an inlet that extends through the convergent portion and an outlet that extends through the divergent portion.

11. The wake manipulating structure of claim 10, wherein the venturi structure is operatively coupled to an outer casing spaced radially outwardly of the outer surface of the combustor liner.

12. The wake manipulating structure of claim 10, wherein the venturi structure is operatively coupled to an end cap of the combustor liner.

13. The wake manipulating structure of claim 10, wherein the at least one slot comprises a mouth region proximate the inlet of the at least one slot.

14. The wake manipulating structure of claim 10, wherein the wake generating component comprises at least one of: a fuel injector, a tube, a spark plug, and a flame detector.

15. The wake manipulating structure of claim 10, wherein the at least one slot comprises a circular cross-sectional geometry.

16. The wake manipulating structure of claim 10, wherein the at least one slot comprises a rectangular cross-sectional geometry.

* * * * *